US010070234B2

(12) United States Patent
Monroy

(10) Patent No.: US 10,070,234 B2
(45) Date of Patent: Sep. 4, 2018

(54) HEARING DEVICE

(71) Applicant: Oticon A/S, Smørum (DK)

(72) Inventor: Lars Monroy, Kongens Lyngby (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 15/381,439

(22) Filed: Dec. 16, 2016

(65) Prior Publication Data

US 2017/0180893 A1 Jun. 22, 2017

(30) Foreign Application Priority Data

Dec. 18, 2015 (EP) ..... 15201066

(51) Int. Cl.
*H04R 25/00* (2006.01)

(52) U.S. Cl.
CPC ..... *H04R 25/65* (2013.01); *H04R 2225/021* (2013.01); *H04R 2225/61* (2013.01)

(58) Field of Classification Search
CPC ..... H04R 25/65; H04R 2225/021; H04R 2225/61
USPC ..... 381/330
See application file for complete search history.

(56) References Cited

U.S. PATENT DOCUMENTS

| | | | | |
|---|---|---|---|---|
| 2004/0120539 | A1* | 6/2004 | Panitzsch | H04R 25/602 381/312 |
| 2008/0273730 | A1 | 11/2008 | Kral et al. | |
| 2008/0298619 | A1 | 12/2008 | Kral et al. | |
| 2010/0220882 | A1 | 9/2010 | Beyfuss et al. | |
| 2011/0268302 | A1* | 11/2011 | Lim | H04R 31/006 381/322 |

FOREIGN PATENT DOCUMENTS

| | | | |
|---|---|---|---|
| CN | 204392567 | U | 6/2015 |
| CN | 204669606 | U | 9/2015 |
| DE | 1 139 549 | B | 11/1962 |
| EP | 2 003 930 | A2 | 12/2008 |
| EP | 2 227 039 | A2 | 9/2010 |
| EP | 2 227 039 | A3 | 6/2013 |
| EP | 2 003 930 | A3 | 1/2015 |
| WO | WO 2010/107389 | A1 | 9/2010 |

* cited by examiner

*Primary Examiner* — Sunita Joshi
(74) *Attorney, Agent, or Firm* — Birch, Stewart, Kolasch & Birch, LLP

(57) ABSTRACT

A hearing device comprising a first shell member and a second shell member constituting a housing when assembled is disclosed. The hearing device comprises a chassis provided with attachment structures for attachment of the first shell member and the second shell member to the chassis.

17 Claims, 4 Drawing Sheets

HEARING DEVICE

FIELD

The present disclosure relates to a hearing device having a housing comprising a chassis. More particularly, the disclosure relates to a hearing device comprising a first shell member and a second shell member constituting a housing when assembled.

BACKGROUND

Many hearing devices comprise a housing formed by a first shell member and a second shell member. The housing comprises several components including a chassis that typically is assembled by wedging it into a basis structure provided at one of the shell members so that the chassis is floating. This type of assembly is associated with several drawbacks. When a sound hook or corda adaptor is attached to the housing and the chassis, a leaking gap is often created between the sound hook/corda adaptor and the receiver suspension as the sound hook/corda adaptor pushes the chassis and the suspension back.

Therefore, there is a need to provide a way of assembling the chassis to the housing in a manner in which a smaller leaking gap is created.

Furthermore, it would be desirable to have a hearing device comprising a chassis that may be used as a standard component in several housings of different designs. Moreover, it would be beneficial to have a collection of components that enables an easy way of creating housings of different design.

SUMMARY

According to an aspect of the disclosure, the hearing device comprises a first shell member and a second shell member constituting a housing when assembled, wherein the hearing device comprises a chassis provided with attachment structures for attachment of the first shell member and the second shell member to the chassis, and the chassis further being configured to support a substrate carrying electrical component, the first shell member is a top shell member and the second shell member is a base shell member, wherein the first shell member and the second shell member surrounds the chassis when attached to the chassis.

Hereby, it is possible to provide a way of assembling the chassis to the housing in a manner in which a smaller leaking gap is created. Further, different kinds of shell parts may be provided so as to allow establishment of different shapes and/or colors of hearing devices having one inner structure and a possible variety of different outer structures.

According to the disclosure, the first shell member may be the upper part of the housing, whereas the second shell member may be the lower part of the housing. According to the disclosure, the first shell member may be the lower part of the housing, whereas the second shell member may be the upper part of the housing.

Advantageously the first shell member and the second shell member may be assembled along a longitudinal axis of the chassis. This allow a top part and a bottom part to be assembled to form the outer housing of the hearing device. Assembly is more easy as one part, e.g. the bottom part, may hold the chassis while the top part is fastened to the hearing device.

According to the disclosure, the housing comprises an amplifier, one or more microphones and a receiver assembly.

The hearing device comprises a chassis provided with attachment structures for attachment of the first shell member and the second shell member to the chassis. The attachment structures may preferably be mechanical attachment structures configured to establish and maintain a firm and reliable fixation of the first shell member and the second shell member to the chassis.

According to the disclosure, the first shell member and the second shell member may surround the chassis when attached to the chassis.

Hereby, the chassis can be used as a mounting basis that is protected by the surrounding structures of the first shell member and the second shell member.

Further according to the disclosure, the chassis may be provided with attachment structures shaped as pinholes.

Hereby, it is possible to let the pinholes receive corresponding attachment members such as pins.

Further according to the disclosure, the chassis may be provided with attachment structures shaped as through-going pinholes.

Hereby, it is possible to insert corresponding attachment members such as pins through the through-going pinholes in order to achieve a reliable and firm attachment.

Even further according to the disclosure, the chassis, the first shell member and the second shell member may be provided with two or more sets of pinholes arranged to form through-going hole structures.

Hereby, each set of pinholes comprises a first through-going hole structure configured to receive a corresponding pin. By means of the through-going hole structure and corresponding structures (e.g. pins), it is possible to assemble the chassis to the first shell member and the second shell member in an easy, fast and reliable manner.

According to the disclosure, the chassis may be provided with two or more pairs of pinholes, wherein each pair of pinholes comprises a first pinhole arranged opposite to a second pinhole and being configured to receive a pin extending through the first pinhole and the a second pinhole.

Hereby, each pairs of pinholes can receive one through-going pin providing a reliable fixation of the chassis to the first shell member and the second shell member in an easy and reliable way.

According to the disclosure, the hearing device may comprise one or more pins configured to be engagingly inserted into the pinholes.

Hereby, an easy and reliable fixation of the chassis to the first shell member and the second shell member can be carried out by engagingly inserting the pins into the pinholes.

According to the disclosure, each of the one or more pins may be a separate rod-shaped one-piece body.

Pins shaped as separate rod-shaped one-piece bodies are easy to produce and to use during the assembling process.

According to the disclosure, the hearing device may comprise two, three or four pins.

Hereby, the chassis can be fixed to the first shell member and the second shell member in several positions. Accordingly, a firm and secure fixation can be achieved by attaching the chassis to the first shell member and the second shell member in several positions.

According to the disclosure, the chassis may comprise a first portion comprising a plate member extending along a first axis and a second portion having a plate member extending along a second axis.

Hereby, the chassis is suitable for being attached to a housing that fits the shape on the ear, e.g. a behind-the-ear (BTE) hearing device.

According to the disclosure, the angle between the first axis and the second axis may be a non-zero angle.

Hereby, a desirable shape of the chassis can be achieved.

The angle may preferably be above 90 degrees, such as 120-150 degrees.

According to the disclosure, the chassis may comprise a support for a terminal wall.

Hereby, a chassis adapted to receive a terminal wall can be achieved.

According to the disclosure, the chassis may comprise a support for a push button.

Hereby, a chassis adapted to receive a push button can be provided.

According to the disclosure, the chassis may comprise one or more snap arms for attachment of an external connector.

The snap arms make it possible to attach an external connector in a fast, easy and secure manner.

According to the disclosure, the chassis may comprise a first pinhole and either a sound hook or a tube adapter provided with a hole or a groove configured to receive a pin, wherein the pinhole and the hole or groove is adapted to receive the pin when the sound hook or the tube adapter is arranged in the housing.

Hereby, a sound hook or a tube adapter can be mechanically attached to the chassis in a fast, secure and reliable manner by simple means.

According to the disclosure, the first shell and/or the second shell may comprise one or more positioning structures for positioning the first shell in a predefined position relative to the second shell.

Hereby, the positioning structures make it possible to position the first shell in a predefined position relative to the second shell.

According to the disclosure, the positioning structures of a shell may protrude from the remaining portion of the shell.

Hereby, the positioning structures are capable of engaging with the opposite shell and hereby function as a guide structure when the first shell and the second shell are joined.

According to the disclosure, the hearing device may comprise a receiver suspension configured to receive the proximal end of the sound hook or a tube adapter.

Hereby, the sound hook or a tube adapter can be attached to the receiver suspension.

According to the disclosure, the hearing device may comprise a first shell and a second shell provided with either plate structures or fastening structures protruding from the remaining portion of the shell, wherein the plate structures or fastening structures are provided with pinholes.

Hereby, the first shell and the second shell can be fixed to each other by means of pins in an easy manner.

Hearing aids are for instance disclosed in US 2004/0120539 which disclose a hearing aid having a case enclosing its electrical components, which includes at least one rechargeable battery.

Further, US 2008/273730 which disclose a hearing device to be worn behind an ear. For individual coloring of the housing of the hearing device, a hearing device containing electromechanical and/or electronic components is provided. The components are accommodated in a divided housing, with the housing being constructed from an upper shell, a first lower shell and a second lower shell which can be releasably fastened to the first lower shell.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effects will be apparent from and elucidated with reference to the illustrations described hereinafter in which:

DETAILED DESCRIPTION

Figure 1A:
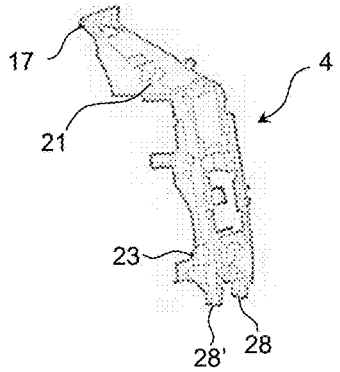
FIG. 1A shows a perspective view of a chassis.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer programs, or any combination thereof.

The printed circuit board may comprise any suitable electronic hardware, including microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signal as an audible signal to at least one of the user's ears. Such audible signals may be provided in the form of an acoustic signal radiated into the user's outer ear, or an acoustic signal transferred as mechanical vibrations to the user's inner ear through bone structure of the user's head and/or through parts of the middle ear of the user or electric signals transferred directly or indirectly to the cochlear nerve and/or to the auditory cortex of the user.

The hearing device is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid or Cochlear Implant, or iv) arranging a unit of the hearing device as an entirely or partly implanted unit such as in a Bone Anchored Hearing Aid or a Cochlear Implant.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include an auxiliary device(s) that communicates with at least one hearing device, the auxiliary device affecting the operation of the hearing devices and/or benefiting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of the following: remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, or a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or in another electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such a directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include an amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

Now referring to FIG. 1A which illustrates a perspective view of a chassis 4. The chassis 4 is adapted to hold at least one substrate where electrical components are mounted, e.g. a printed circuit board with one or more of a number of components, such as digital processor, memory, microphone, wireless interface or the like. The substrate may be formed by several parts, such as two as illustrated in FIG. 2, left part. As illustrated, the substrate may be stored on one side of the chassis 4, e.g. the top side, and a room or compartment or are may be provided at the other side, e.g. the bottom side, for holding a battery for powering the electrical components in the hearing device. The chassis 4 comprises a central body member provided which a plurality of pinholes 18, 21, 23. A first pinhole 17 is provided in a first end portion of the chassis 4. This pinhole 17 is configured to engagingly receive a corresponding pin for fixing a sound hook or a sound tube (see FIG. 3) and for attaching the housing to the chassis 4. A cavity or receptacle may be formed in the central body member of the chassis. The substrate may be shaped to fit into the cavity. The cavity may include one, two or more retention member shaped so as to ensure the substrate is kept in place in the cavity during use of the hearing device.

A second pinhole 21 is provided in a distance from the first end portion of the chassis 4. The second pinhole 21 is adapted to engagingly receive a corresponding pin for fixing the housing to the chassis 4.

Furthermore, a third pinhole 23 is provided close to the second opposite end portion of the chassis 4. The third pinhole 23 is configured to engagingly receive a corresponding pin for fixing the housing to the chassis 4.

A first arm 28 and a second arm 28' configured to attach an external connector to the chassis is provided in the second opposite end portion of the chassis 4. The arms 28, 28' protrude from the remaining structure of the chassis 4.

Figure 1B:
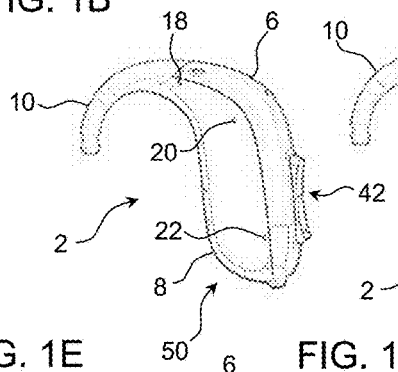
FIG. 1B shows a side view of a hearing device.

FIG. 1B illustrates a side view of a hearing device 2. The hearing device 2 comprises a housing 50 having a base shell member 8 and a top shell member 6 attached to the base shell member 8. A chassis like the one shown in FIG. 1A is arranged in the housing 50.

The hearing device 2 comprises a press button 42 protruding from an opening provided in the top shell member 6. The hearing device 2 comprises a first through-going hole 18, a second through-going hole 20 and a third through-going hole 22 each positioned to receive a pin. Furthermore, the first through-going hole 18 is arranged in a position in which a pin at the same time can be received by a pinhole in the sound hook 10, the first pinhole provided in the first end portion of the chassis (see FIG. 1A) as well as the through-going hole 18. Hereby, it is possible to attach the sound hook 10, the base shell member 8, the top shell member 6 and the chassis to each other by means of the through-going hole 18. In FIG. 1 B, a sound hook 10 is attached to the housing 50 by means of a pin engagingly received by a pinhole 18 going through the base shell member 8, the top shell member 6 and the sound hook 10 as well as the chassis inside the housing 50.

The second through-going hole 20 is arranged in a position in which a pin at the same time can be received by the second pinhole provided in the chassis (see FIG. 1A) as well as the through-going hole 20. Accordingly, the base shell member 8 and the top shell member 6 can be attached to each other and to the chassis by using the through-going hole 20.

Likewise, the third through-going hole 22 is arranged in a position in which a pin at the same time can be received by the third pinhole provided in the chassis (see FIG. 1A) as well as the through-going hole 22. Accordingly, the base shell member 8 and the top shell member 6 can be attached to each other and to the chassis by means of the through-going hole 22.

Figure 1C:
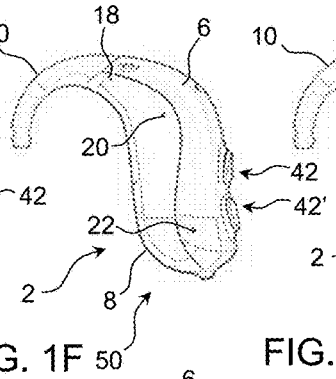
FIG. 1C shows a side view of a hearing device.
Figure 1D:
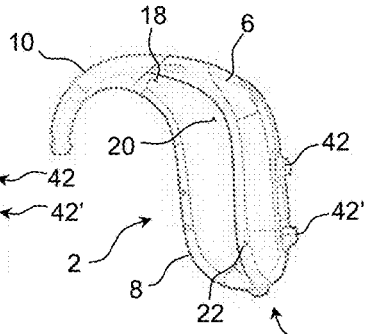
FIG. 1D shows a side view of a hearing device.
Figure 1E:
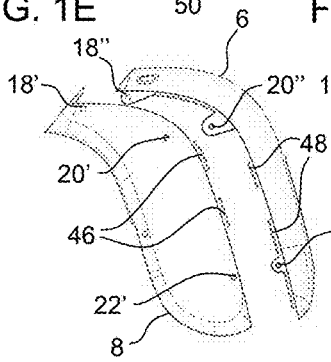
FIG. 1E shows a side view of a hearing device.

In FIG. 1E, the base shell member 8 and the top shell member 6 of the hearing device 2 shown in FIG. 1B are illustrated in a configuration in which the base shell member 8 and the top shell member 6 are separated from each other. It can be seen that the base shell member 8 comprises a first pinhole structure 18', a second pinhole structure 20' and a second pinhole structure 22' corresponding with a first pinhole structure 18", a second pinhole structure 20" and a second pinhole structure 22" provided in the top shell member 6. Furthermore, the first pinhole structures 18', 18" constitute the pinhole 18 illustrated in FIG. 1B. Likewise, the second pinhole structures 20', 20" constitute the pinhole 20, while the third pinhole structures 22', 22" constitute the pinhole 22 illustrated in FIG. 1B.

The base shell member 8 comprises several positioning structures 46 for positioning the base shell member 8 relative to the top shell member 6. Likewise, the top shell member 6 comprises several positioning structures 48 for positioning the base shell member 8 relative to the top shell member 6. The positioning structures 46, 48 of the shell members 6, 8 protrude from the remaining portion of the respective shell member 6, 8.

Accordingly, the positioning structures have a guiding function and are capable of engaging with the opposite shell member when the top shell member 6 and the base shell member 8 are joined.

FIG. 1C and FIG. 1D illustrate side views of two different hearing devices 2 according to the disclosure. In FIG. 1C and FIG. 1D, the hearing device 2 comprises a housing 50 having a base shell member 8 and a top shell member 6 attached to the base shell member 8. Furthermore, a chassis like the one shown in FIG. 1A is arranged in the housing 50.

The hearing device 2 comprises a first press button 42 and a second press button 42' protruding from a first and a second opening provided in the top shell member 6.

The hearing device 2 comprises a first through-going hole 18, a second through-going hole 20 and a third through-going hole 22 each positioned to receive a pin. Besides, the first through-going hole 18 is arranged in a position in which a pin at the same time can be received by a pinhole in the sound hook 10, the first pinhole provided in the first end portion of the chassis (as can be seen FIG. 1A) as well as the through-going hole 18. Accordingly, the sound hook 10, the base shell member 8, the top shell member 6 and the chassis can be fixed to each other means of the through-going hole 18. A sound hook 10 has been engagingly received by the housing 50 by means of a pin inserted into a pinhole 18 going through the base shell member 8, the top shell member 6 and the sound hook 10 as well as the chassis inside the housing 50.

The second through-going hole 20 is arranged in a position allowing a pin to be received by the second pinhole provided in the chassis (see FIG. 1A) as well as the through-going hole 20 at the same time. Thus, the base shell member 8 and the top shell member 6 are configured to be fixed to each other and to the chassis by means of the through-going hole 20.

In the same way, the third through-going hole 22 is arranged in a position in which a pin can be received by the third pinhole provided in the chassis (shown in FIG. 1A) as well as the through-going hole 22, at the same time. Accordingly, the base shell member 8 and the top shell member 6 can be attached to each other and to the chassis by means of the through-going hole 22.

Figure 1F:
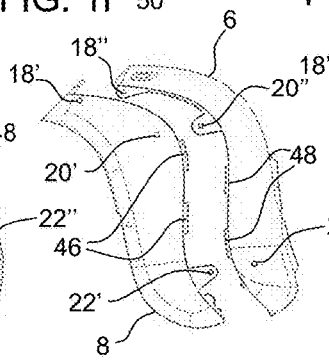
FIG. 1F shows a side view of a hearing device.
Figure 1G:
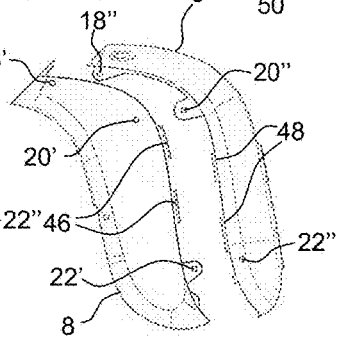
FIG. 1G shows a side view of a hearing device.

In FIG. 1F, the base shell member 8 and the top shell member 6 of the hearing device 2 shown in FIG. 1C are illustrated in a configuration in which the base shell member 8 and the top shell member 6 are separated from each other. Likewise, in FIG. 1G, the base shell member 8 and the top shell member 6 of the hearing device 2 shown in FIG. 1D are illustrated in a configuration in which the base shell member 8 and the top shell member 6 are separated from each other.

It can be seen that the base shell member 8 comprises a first pin-hole structure 18', a second pin-hole structure 20' and a second pin-hole structure 22' corresponding with a first pinhole structure 18", a second pin-hole structure 20" and a second pinhole structure 22" provided in the top shell member 6. Furthermore, the first pinhole structures 18', 18" constitute the pinhole 18 illustrated in FIG. 1C and in FIG. 1D. Likewise, the second pinhole structures 20', 20" constitute the pinhole 20, while the third pinhole structures 22', 22" constitute the pinhole 22 illustrated in FIG. 1C and in FIG. 1D.

The base shell member 8 comprises several positioning structures 46 for positioning the base shell member 8 relative to the top shell member 6. Likewise, the top shell member 6 comprises several positioning structures 48 for positioning the base shell member 8 relative to the top shell member 6. The positioning structures 46, 48 of the shell members 6, 8 protrude from the remaining portion of the respective shell member 6, 8.

The positioning structures 46, 48 are configured to engagingly guide the joining process of the opposite shell member when the top shell member 6 and the base shell member 8 are joined.

By having a chassis as illustrated in FIG. 1, it is possible to use the same chassis and pins to assemble housings of different types and designs, like illustrated in FIG. 1 B-G.

Figure 2B:
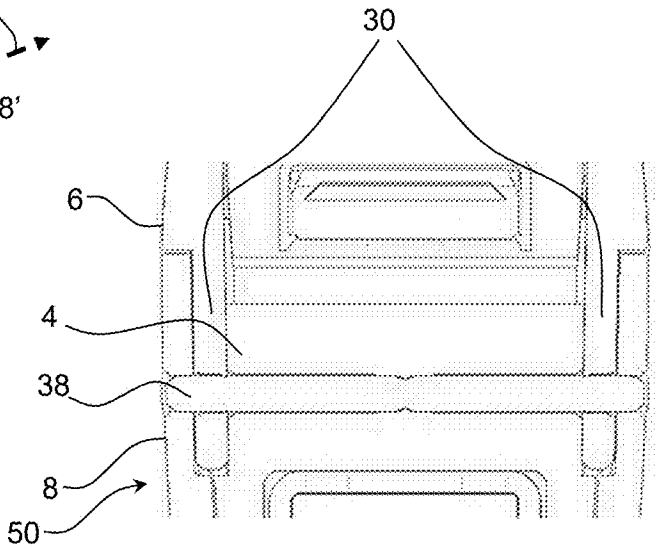
FIG. 2B shows a top view of a chassis and a pin used to attach a plate member to the chassis.
Figure 2A:
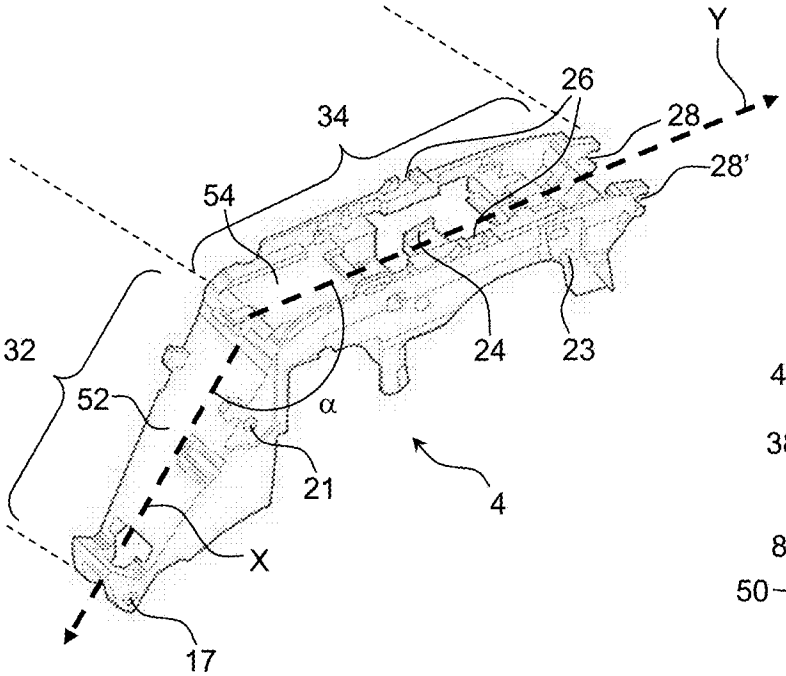
FIG. 2A shows a perspective view of a chassis.

FIG. 2A illustrates a perspective view of a chassis 4.

The chassis 4 comprises a first portion 32 comprising a plate member 52 having a longitudinal axis X. A first pinhole 17 and a second pinhole 20 are provided in the first portion 32. Four parts are formed, by extending from the chassis, to hold a substrate with electronic components, such as a printed circuit board with a number of components thereon. The printed circuit board will be arranged parallel to the plate member 52. The pinhole 17 is adapted to engagingly receive a corresponding pin for fixing a sound hook or a sound tube (as illustrated in FIG. 3) and for fixing the housing to the chassis 4.

The chassis 4 comprises a second portion 34 comprising a plate member 54 having a longitudinal axis Y. A number of wall parts are formed to hold a second substrate with electronic components, such as a second printed circuit board with a number of components thereon. The second printed circuit board will be arranged parallel to the plate member 54. The second portion 34 comprises a pinhole 21 configured to engagingly receive a corresponding pin for fixing a housing to the chassis 4. The second portion 34 comprises a third pinhole 23 adapted to engagingly receive a corresponding pin for fixing a housing to the chassis 4.

A first arm 28 and a second arm 28' configured to attach an external connector to the chassis is provided at the second portion 34 of the chassis 4. The arms 28, 28' protrude from the remaining structure of the second portion 34 of the chassis 4.

The second portion 34 furthermore comprises a support 24 for a terminal wall and support structures 26 for a push button.

The angle α between the longitudinal axis X of the first portion 32 and the longitudinal axis of the second portion 34 is indicated in FIG. 2A. It can be seen that the angle α is approximately 140 degrees.

FIG. 2B illustrates a top view of a chassis 4 and a pin 38 used to attach a plate member 30 of a top shell member 6 to the chassis 4 and to a base shell member 8. It can be seen that the pin 38 extends through pinholes in the base shell member 8, the top shell member 6 and the chassis 4.

Figure 3A:
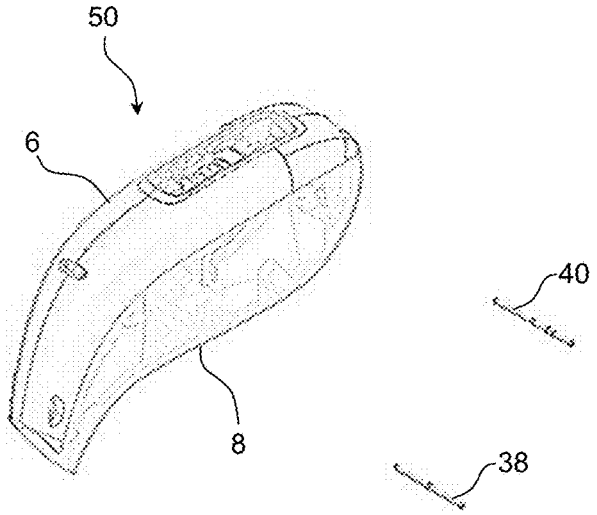
FIG. 3A shows a perspective view of a hearing device.

FIG. 3A illustrates a perspective view of a hearing device 2. The hearing device 2 comprises a housing 50 having a top shell member 6 and a base shell member 8. A first pin 36, a second pin 38 and a third pin 40 configured to be received by the pinholes of the housing and chassis of the hearing device 2 are shown next to the housing 50.

Figure 3B:
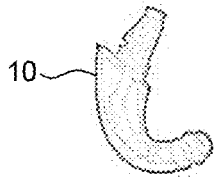
FIG. 3B shows a perspective view of a sound hook.

FIG. 3B illustrates a perspective view of a sound hook 10. The sound hook 10 is configured to be inserted into and attached to the housing 50.

Figure 3C:
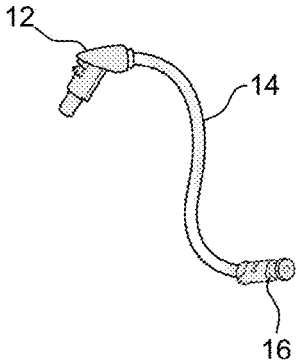
FIG. 3C shows a perspective view of a sound tube.

FIG. 3C illustrates a perspective view of a sound tube 14. A tube adapter 12 is attached to the first end of the sound tube 14, whereas a receiver 16 is attached to the opposite end of the sound tube 14. The sound tube 14 is configured to be inserted into and attached to the housing 50.

Figure 3D:
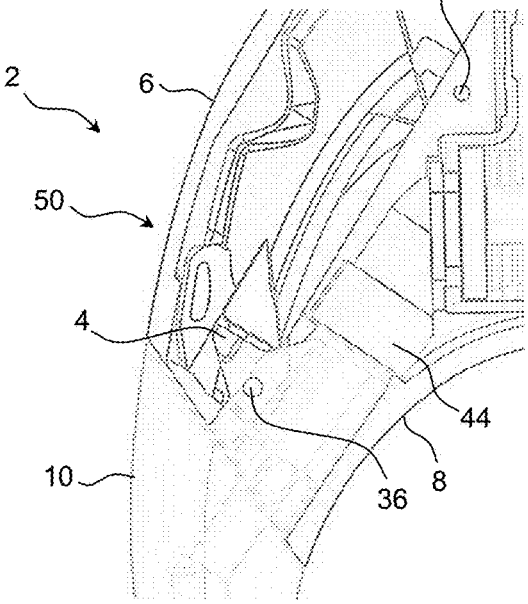
FIG. 3D shows a perspective view of a hearing device in which one shell member has been removed for illustration purposes and FIG. 4 shows a perspective exploded view of a hearing device.

FIG. 3D illustrates a perspective view of a hearing device 2 in which half of the base shell member 8 and the top shell member 6 has been removed for illustration purposes. The hearing device 2 comprises a sound hook 10 attached to a housing 50 comprising a top shell member 6.

A first pin 36 and a second pin 38 have been inserted into pinholes provided in the chassis 4 of the hearing device 2. The sound hook 10 is fixed to a housing 50 by means of a first pin 36. Furthermore, the sound hook 10 is connected to a receiver suspension 44.

Figure 4:
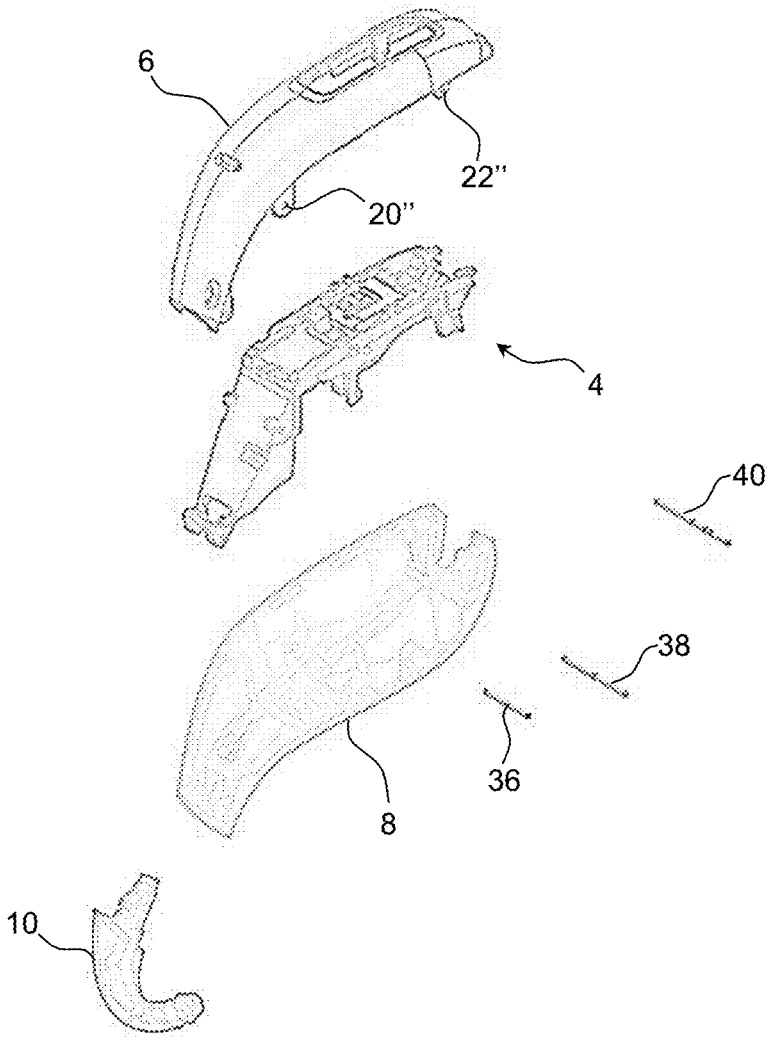

FIG. 4A illustrates a perspective exploded view of a hearing device 2. The hearing device 2 comprises a top shell member 6 provided with pinhole structures 20", 22". The hearing device 2 moreover comprises a base shell member 8, a chassis 4 and a sound hook 10. The hearing device is a BTE hearing device 2. A first pin 36, a second pin 38 and a third pin 40 configured to be received by the pinholes structures 20", 22" (and corresponding pinhole structures in the base shell member 8 and in holes of the chassis 4 are shown next to the housing 50.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element, but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

LIST OF REFERENCE NUMERALS

2 Hearing device
4 Chassis
6 Top shell member
8 Base shell member
10 Sound hook
12 Tube adapter
14 Sound tube
16 Receiver
17, 18 Pinhole
18', 18" Pinhole structure
20, 21, 22, 23 Pinhole
20', 20" Pinhole structure
22', 22" Pinhole structure
24 Support (for terminal wall)
26 Support (for push button)
28, 28' Arm for external connector
30 Plate member
32 First portion
34 Second portion
36, 38, 40 Pin
42, 42' Push button
44 Receiver suspension
46, 48 Positioning structures
50 Housing
52, 54 Plate member
X, Y Longitudinal axis
α Angle

The invention claimed is:

1. A hearing device comprising a first shell member and a second shell member constituting a housing when assembled, wherein the hearing device comprising a chassis provided with attachment structures for attachment of the first shell member and the second shell member to the chassis, and first and second substrates carrying electrical components which are supported by the chassis, the first shell member is a top shell member and the second shell member is a base shell member, wherein the first shell member and the second shell member surrounds the chassis when attached to the chassis, the chassis comprises a first portion comprising a plate member extending along a first axis and a second portion having a plate member extending along a second axis, and the first substrate and the second substrate are arranged parallel to the plate members of the first portion and the second portion respectively such that the plate member of the first portion substantially covers a bottom surface of the first substrate and the plate member of the second portion substantially covers a bottom surface of the second substrate, wherein the chassis is provided with attachment structures shaped as pinholes and wherein a corresponding number of pins configured to be engagingly inserted into the pinholes are arranged so as to releasably fixate the chassis to the first shell member and the second shell member.

2. The hearing device according to claim 1, wherein the first shell member and the second shell member are assembled along a longitudinal axis of the chassis.

3. A hearing device according to claim 1, wherein the chassis, the first shell member and the second shell member are provided with two or more sets of pinholes arranged to form through-going hole structures.

4. A hearing device according to claim 3, wherein the chassis is provided with two or more pairs of pinholes, wherein each pair of pinholes comprising a first pinhole arranged next to a second pinhole and being configured to receive a pin extending through the first pinhole and the a second pinhole.

5. The hearing device according to claim 4, wherein each of the one or more pins is a separate rod-shaped one-piece body.

6. The hearing device according to claim 1, wherein the hearing device comprises two, three or four pins.

7. The hearing device according to claim 1, wherein the angle between the first axis and the second axis is a non-zero angle.

8. The hearing device according to claim 1, wherein the chassis comprises a support for a terminal wall.

9. The hearing device according to claim 1, wherein the chassis comprises a support for a push button.

10. The hearing device according to claim 1, wherein the chassis comprises one or more snap arms for attachment of an external connector.

11. The hearing device according to claim 1, wherein the chassis comprises a first pinhole and either a sound hook or a tube adapter provided with a hole or a groove configured to receive a pin, wherein the first pinhole and the hole or groove are adapted to receive the pin when the sound hook or the tube adapter is arranged at the housing.

12. The hearing device according to claim 1, wherein the first shell and/or the second shell comprises one or more positioning structures for positioning the first shell in a predefined position relative to the second shell.

13. The hearing device according to claim 1, wherein the hearing device is configured to receive and process ambient sound so as to compensate for a wearers hearing loss.

14. A hearing aid device comprising a top shell member and a bottom shell member together constituting a housing when assembled, wherein the top shell member and the bottom shell member are assembled along a longitudinal axis of the housing, the hearing device comprising a chassis received between the top shell member and the bottom shell member, the chassis provided with attachment structures for attachment of the first shell member and the second shell member to the chassis, wherein the attachment structures are shaped as pinholes configured to receive correspondingly shaped pins so that when the top shell member and the bottom shell member are assembled around the chassis the pins lock the top shell member to the bottom shell member and the chassis is fixated inside the housing, the hearing aid comprising first and second substrates carrying electrical components which are supported by the chassis, wherein the chassis comprises a first portion comprising a plate member extending along a first axis and a second portion having a plate member extending along a second axis, wherein the first substrate is arranged parallel to the plate member of the first portion such that the plate member of the first portion substantially covers a bottom surface of the first substrate, and wherein the second substrate is arranged parallel to the plate member of the second portion such that the plate member of the second portion substantially covers a bottom surface of the second substrate.

15. The hearing aid device according to claim 14, wherein a sound processor is arranged on the first substrate and/or the second substrate.

16. The hearing aid device according to claim 14, wherein the angle between the first axis and the second axis is a non-zero angle.

17. The hearing aid device according to claim 14, wherein the chassis comprises a first pinhole and either a sound hook or a tube adapter provided with a hole or a groove configured to receive a pin, wherein the pinhole and the hole or groove is adapted to receive the pin when the sound hook or the tube adapter is arranged in the housing.

* * * * *